United States Patent [19]

Bolton et al.

[11] 4,240,639

[45] Dec. 23, 1980

[54] TOSS BALL CONSTRUCTION

[75] Inventors: Douglas R. Bolton, Chicago, Ill.; John M. Werling, Kansas City, Mo.

[73] Assignee: Cadaco, Inc., Chicago, Ill.,

[21] Appl. No.: 36,250

[22] Filed: May 4, 1979

[51] Int. Cl.[3] ..... A63B 65/00

[52] U.S. Cl. ..... 273/346; 273/58 B; 428/136; 428/100; 428/11

[58] Field of Search ..... 273/58 K, 58 B, 58 BA, 273/58 R, 58 A, 58 D, 58 E, 346; 428/11, 100, 134, 136; 46/DIG. 1

[56] References Cited

U.S. PATENT DOCUMENTS

| | | | |
|---|---|---|---|
| 2,011,760 | 8/1935 | Gallinant | 273/58 D |
| 3,032,345 | 5/1962 | Lemelson | 46/DIG. 1 |
| 3,917,271 | 11/1975 | Lemelson et al. | 46/DIG. 1 |
| 3,927,881 | 12/1975 | Lemelson et al. | 46/DIG. 1 |
| 4,053,156 | 10/1977 | Bai | 273/58 K |

FOREIGN PATENT DOCUMENTS

| | | | |
|---|---|---|---|
| 85841 | 7/1958 | Denmark | 428/11 |

*Primary Examiner*—George J. Marlo

*Attorney, Agent, or Firm*—Wegner, Stellman, McCord, Wiles & Wood

[57] ABSTRACT

A ball adapted to cling to a textile surface as an incident of being tossed thereagainst. The ball includes a lightweight spherical body having affixed to the external surface thereof a sheet of flexible Velcro fabric. The sheet is provided with a plurality of slits defining therebetween longitudinal strips. Prior to affixation to the spherical body surface, the sheet may have a generally rectangular configuration, with the slits extending parallel to each other and terminating in spaced adjacency to the opposite ends of the sheet. When formed about the spherical body, the slits are spread to have a maximum width about a circumferential portion of the spherical body. The strips are joined at one end by a first end wall extending polygonally about one portion of the spherical body and at the opposite end by a second end wall extending similarly polygonally about a diametrically opposite portion of the spherical body. The end walls may be turned from the strips to extend outwardly from the surface of the spherical body.

10 Claims, 3 Drawing Figures

TOSS BALL CONSTRUCTION

BACKGROUND OF THE INVENTION

1. Field of the Invention

This invention relates to toss balls, and in particular to balls provided with Velcro adhering means, such as for use in games and the like wherein the ball is tossed against a complementary textile material to which the Velcro material of the ball may cling.

2. Description of the Background Art

In one common form of toss ball game, a lightweight ball is provided on its outer surface with Velcro fabric material so as to cling to a textile material against which the Velcro covered ball is tossed in playing the game.

A number of different constructions have been developed in forming such toss balls. More specifically, one form of toss ball utilizing Velcro adhesive material on the surface thereof is shown in U.S. Pat. No. 3,032,345 of Jerome H. Lemelson. As shown therein, in FIG. 5, the ball includes a base portion which is formed of suitable rigid or deformable material, such as plastic, rubber, leather, or the like. The Velcro material is provided in the form of a plurality of circular patches which may be cemented, stapled, stitched, or otherwise secured to the base. Alternatively, Lemelson teaches that the hooking material may be provided in the form of a strip extending partly or completely around the sphere as a belt. The patentee further teaches that the hooking material may be alternatively arranged to cover the entire spherical surface or only limited areas thereof. In a preferred form, the base is disclosed as preferably formed of resilient or otherwise deformable material. The patentee further teaches that the base may be a hollow spherical shell of rubber or resilient plastic, such as plasticized vinyl, or alternatively, may be made of cloth or leather with the interior thereof stuffed with cotton, foamed plastic, or other suitable material which will permit the spherical body to maintain its shape while deflecting when the ball strikes a rigid surface. Still further, the patentee teaches that the ball may be formed of a flexible vinyl sheeting or the like which is inflated or inflatable to the shape of a ball or sphere.

In U.S. Pat. No. 3,917,271 of Jerome H. Lemelson et al., a modified form of ball is disclosed formed of a hollow spheroid having oblong indentations in its outer surface receiving similarly shaped segments of the Velcro fabric.

In U.S. Pat. No. 3,927,881 of Jerome H. Lemelson et al., a lightweight hollow ball is provided with the Velcro hooks being molded integrally with the wall of the ball. In one form, the ball is provided with sections of Velcro fabric which entirely cover the ball surface.

SUMMARY OF THE INVENTION

The present invention comprehends an improved ball construction wherein a sheet of Velcro fabric is affixed to a spherical body in a novel and simple manner, permitting the toss ball to be formed at extremely low cost.

More specifically, the invention comprehends the provision of such a ball adapted to cling to a textile surface against which it is thrown which is provided with a lightweight spherical body and a sheet of flexible Velcro fabric affixed to the body and having spread parallel slits defining therebetween longitudinal strips having a first end joined by a first end wall extending polygonally about one portion of the spherical body and an opposite end joined by a second end wall extending polygonally about a diametrically opposite portion of the spherical body.

The Velcro fabric sheet comprises a spherically expandable slit rectangular sheet.

In the illustrated embodiment, each of the strips of the sheet is of equal width.

In the illustrated embodiment, the rectangular sheet may have a width perpendicular to the slits approximately equal to one-quarter of the circumference of the spherical body.

In the illustrated embodiment, the maximum spacing between the strips on the spherical body is substantially greater than the width of the individual strips.

The end walls may extend outwardly from the surface of the sphere, and in the illustrated embodiment, are turned substantially perpendicularly from the strips at the opposite ends thereof.

In the illustrated embodiment, five such strips are utilized with the end wall defining a pentagonal configuration.

In the illustrated embodiment, the spherical body is formed of foamed synthetic resin.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
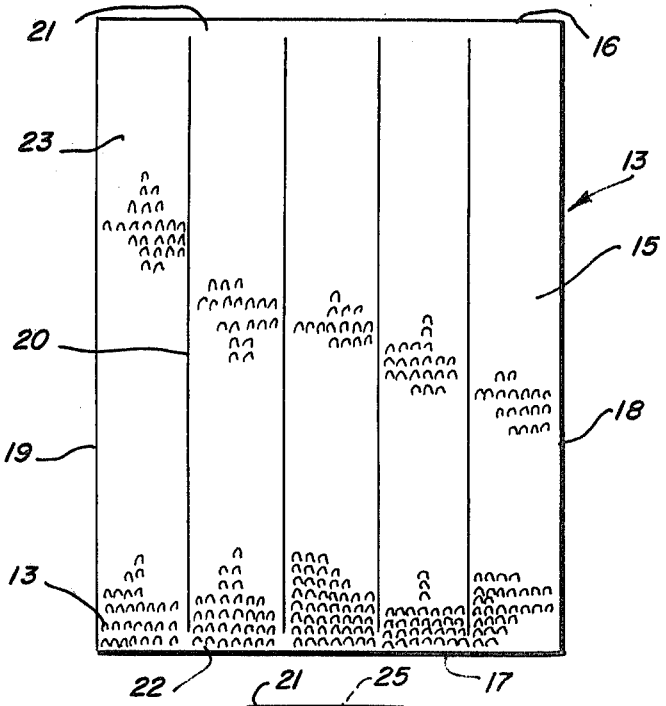
FIG. 1 is a plan view of a sheet of flexible Velcro fabric provided with slits for use in a ball construction embodying the invention.

In the exemplary embodiment of the invention as disclosed in the drawing, a toss ball generally designated 10 is shown to comprise a lightweight spherical body 11 provided with an outer element 12 formed of a sheet of flexible Velcro fabric. Velcro fabric is well known to those skilled in the art.

Briefly, however, the Velcro fabric is provided with a plurality of hooks 13 projecting outwardly from a base sheet portion 14 and defining means for hookedly engaging a complementary textile sheet or the like serving as a target for the ball.

The present invention is concerned with an improved simplified arrangement of the Velcro fabric 13 permitting low cost manufacture of the toss ball.

More specifically, as seen in FIG. 1, the Velcro fabric may be provided in the form of a rectangular sheet generally designated 15 having opposite ends 16 and 17 and sides 18 and 19. The sheet is provided with a plurality of parallel slits 20 extending parallel to the sides 18 and 19 and terminating short of the ends 16 and 17 so as to define end wall portions 21 and 22 joining the strips 23 formed by the slits 20.

Figure 2:
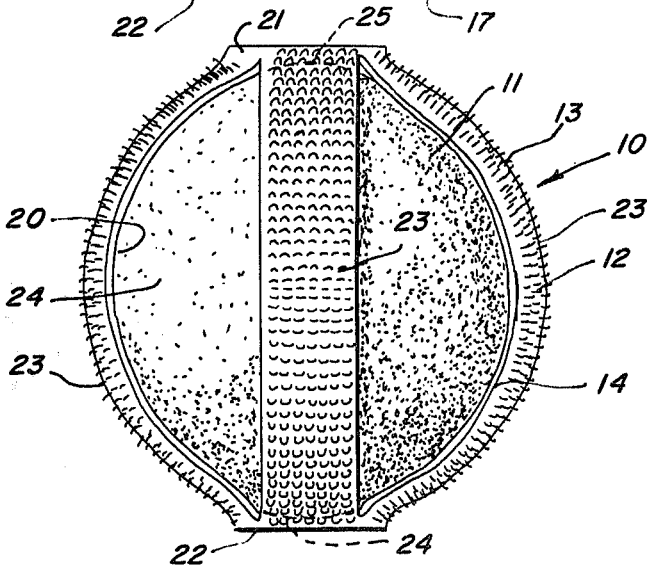
FIG. 2 is a side elevation of a ball construction embodying the invention.
Figure 3:
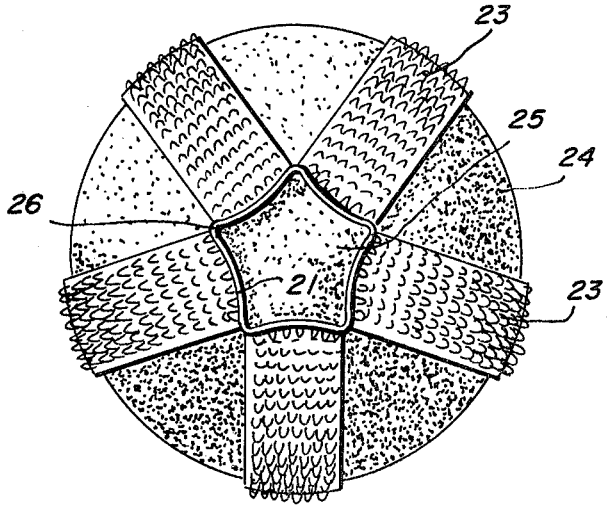
FIG. 3 is an end view thereof.

Toss ball 10 is formed by affixing the base portion 14 of the sheet 15 to the outer surface of the spherical body 11 by suitable means, such as adhesive, with the slits 20 spread apart so as to space the strips 23 equiangularly about the circumferential portion 24 of the spherical body. As seen in FIGS. 2 and 3, the spacing between the strips 23 at the circumference 24 of the spherical body may be greater than the width of the strips.

As indicated above, however, the strips are joined at their opposite ends by the end walls 21 and 22. When the strips 23 are arrayed equiangularly about the ball as indicated above, the end walls define a polygonal configuration, as best seen in FIG. 3, about diametrically opposite portions of the spherical body, such as portion 25 shown in FIG. 3.

As shown in FIGS. 2 and 3, the end walls 21 and 22 extend generally perpendicularly to the strips at the ends thereof so as to extend outwardly from the surface of the spherical body and thereby forming strong interconnections 26 between the respective strips 23.

As indicated above, Velcro fabric 13 may comprise conventional fabric material as provided by Velcro Corporation of New York, New York. The fabric is provided with small monofilament hooks 13 protruding the base 14 whereby thousands of such hooks are provided in each square inch of the fabric. The fabric is flexible and may be readily formed by die cutting to provide the slits 20 with the flexibility of the fabric permitting facilitated disposition of the sheet 15 in the spread-apart arrangement of FIGS. 2 and 3.

The spherical body 11 may be formed of any suitable lightweight material, such as expanded foam plastic. In the illustrated embodiment, the body 11 is formed of lightweight expanded polystyrene.

In the illustrated embodiment, four slits 20 are provided so as to define five strips 23, thereby defining the pentagonal arrangement of the end walls 21 and 22. As will be obvious to those skilled in the art, other suitable slit and strip arrangements may be utilized within the scope of the invention as desired.

Toss ball 10 provides the highly desirable feature of defining to the user a preselected diametric axis of the ball so that the ball may be tossed in substantially the same manner in each of successive repetitive tossings. Thus, the toss ball 10 has been found to provide a substantial improvement over the prior art toss balls utilizing Velcro adhesion materials, while at the same time providing a low cost, simplified construction.

The foregoing disclosure of specific embodiments is illustrative of the broad inventive concepts comprehended by the invention.

We claim:

1. In a ball adapted to cling to a textile surface as an incident of being tossed thereagainst, the ball including a lightweight spherical body, the improvement comprising a sheet of flexible Velcro fabric affixed to said body and having spread parallel slits defining therebetween longitudinal strips having a first end joined by a first end wall extending polygonally about one portion of the spherical body and an opposite end joined by a second end wall extending polygonally about a diametrically opposite portion of the spherical body, each of said end walls projecting outwardly from the surface of the spherical body and forming strong interconnections between said strips.

2. The toss ball of claim 1 wherein said sheet comprises a spherically expanded slit rectangular sheet.

3. The toss ball of claim 1 wherein each of said strips is of equal width.

4. The toss ball of claim 1 wherein said interconnections of the end walls comprise folded portions of said sheet.

5. The toss ball of claim 1 wherein said end walls are turned substantially perpendicularly from said strips.

6. The toss ball of claim 1 wherein said sheet defines at least five said strips.

7. The toss ball of claim 1 wherein said strips are equiangularly spaced about said spherical body.

8. The toss ball of claim 1 wherein said strips are equiangularly spaced about said spherical body, the maximum spacing being substantially greater than the width of the strips.

9. The toss ball of claim 1 wherein said sheet prior to affixation to the spherical body defines a slit rectangular sheet having a width perpendicular to the slits approximately equal to one-quarter the circumference of said spherical body.

10. The toss ball of claim 1 wherein said spherical body is formed of foamed synthetic resin.

* * * * *